United States Patent [19]

Lively, Sr.

[11] Patent Number: 5,029,559

[45] Date of Patent: Jul. 9, 1991

[54] OPPOSED PISTON ENGINE HAVING FUEL INLET THROUGH ROD CONTROLLED PISTON PORT

[76] Inventor: Edmund P. Lively, Sr., P.O. Box 143, Washington Grove, Md. 20880-0143

[21] Appl. No.: 536,291

[22] Filed: Jun. 11, 1990

[51] Int. Cl.[5] ..... F01L 11/00

[52] U.S. Cl. ..... 123/47 A; 123/51 BD; 123/65 BA

[58] Field of Search ..... 123/51 B, 51 BA, 51 BD, 123/575, 47 A, 51 R, 65 A, 65 B, 65 BA, 47 R, 1 A

[56] References Cited

U.S. PATENT DOCUMENTS

| | | | |
|---|---|---|---|
| 1,022,864 | 4/1912 | Moore et al. | 123/47 A |
| 1,131,257 | 3/1915 | Moore et al. | 123/47 A |
| 2,139,457 | 12/1938 | Patchett | 123/47 A |
| 2,393,085 | 1/1946 | Wuehr | 123/51 BD |
| 2,768,616 | 10/1956 | Venediger | 123/51 BD |
| 2,781,031 | 2/1957 | Barberi | 123/47 A |
| 3,712,276 | 1/1973 | Foster | 123/47 R |
| 4,071,000 | 1/1978 | Herbert | 123/51 BD |
| 4,217,865 | 8/1980 | Barrett | 123/47 A |
| 4,250,844 | 2/1981 | Tews | 123/47 A |
| 4,566,408 | 1/1986 | Lapeyre | 123/51 BD |

*Primary Examiner*—David A. Okonsky

[57] ABSTRACT

An opposed piston two cycle internal combustion engine. The movement of the opposed pistons is transmitted to two cranks, the two cranks are interlocked together by gears. The gears maintain synchronized movement of the cranks and further act as an air pump to force air intothe intake manifold 20. A fuel charge is admitted into the intake tube 19 and is controlled by the rotary valve 17 for admission into a pre-compression crankcase 3. The rotary valve allows for further communication between the precompression crankcase 3 and injection crankcase 2 via passage 22. Air is introduced into the combustion space 10 via inlet ports 14. A fuel/air mixture is further controllably introduced via a fuel injection port 13 in the injection piston 4. The exhaust ports 15 are opened prior the timing of the intake ports 14 and close prior the closing of the intake ports 14 for superior scavenging.

3 Claims, 9 Drawing Sheets

OPPOSED PISTON ENGINE HAVING FUEL INLET THROUGH ROD CONTROLLED PISTON PORT

FIELD OF THE INVENTION

The present invention relates generally to two-cycle engines and more particularly to an opposed piston arrangement.

SUMMARY OF THE INVENTION

The two-cycle engine operates with two crankshafts, one on each end of a central cylinder. Each crankshaft serves a respective opposed piston. The cylinder is provided with a set of ports at each end. One end of the cylinder has air inlet ports and the other end is provided with exhaust ports. Each of the ports are located in the cylinder wall and are controlled by the pistons.

One of the opposed pistons serves as a means for fuel injection. The injection piston is operated on the end of the cylinder including the exhaust ports and acts to control such. The back face of the piston has a depression or acetabulum in which the connecting rod acts. A port or aperture is formed in the piston crown which directly communicates with the depression. The terminal end of the connecting rod oscillates in the depression acting to controllably block or allow passage of fuel through the injection port.

DETAILED DESCRIPTION OF THE PREFERRED EMBODIMENT

Figure 1:
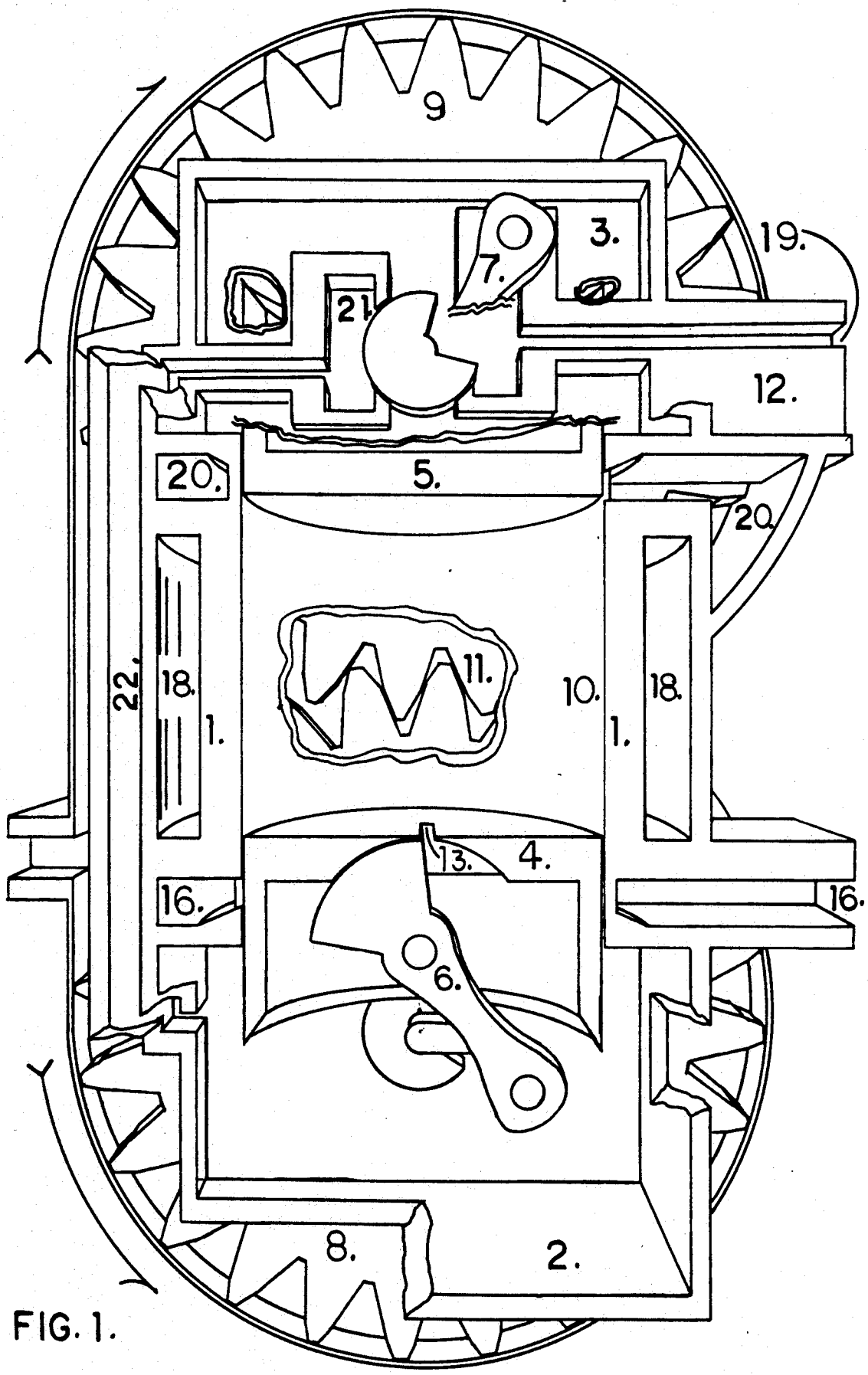
FIG. 1 is a sectional view through the two cycle engine of the present invention.

Referring initially to FIG. 1, the engine of the present invention is shown to include an elongate combustion cylinder 1, open at each end to connect with first and second crankcases 2 and 3, respectively. Throughout the following description it will be recognized by those skilled in the art that normal engineering design practices will be implemented in manufacturing and assembling the various components of the engine.

Each of the crankcases 2 and 3 houses a crankshaft and flywheel assembly 8 and 9, respectively, each rotatable about an axis perpendicular to the plane of FIG. 1 in journals. Each of the crankshaft assemblies 8 and 9, through an eccentric rod journal, pivotally mounts a piston rod 6 and 7, respectively, which piston rods are in turn journalled on wrist pins to a pair of pistons 4 and 5, respectively. The flywheels of the crankshaft and flywheel assemblies 8 and 9 are each provided with a peripheral toothed surface. Seen immediately behind the combustion chamber 10, through a cutaway portion of the cylinder 1, are the teeth of the flywheels meshing at 11 in casing 12 thereby maintaining said pistons in cooperation. The gears further act as an air pump forcing air through the intake ports 14 as discussed herein below. The flywheels thereby rotate in opposite directions as depicted in FIG. 1.

Each of the crankcases 2 and 3 is utilized for pumping intake fuel mixtures into the combustion chamber 10 within the cylinder 1. Upon an upstroke of the piston 5 a partial vacuum is created in the pre-compression crankcase 3. The partial vacuum draws propane or similar charge through the intake tube 19 and past a counterweight rotary valve 17 into the crankcase 3. In the crankcase 3 it mixes with minute amounts of vapor from the hot pre-compression oil pan to form the pre-compression crankcase gas.

FIG. 1 illustrates the pistons as they advance in an upstroke. Note that the gas that was passed into the crankcase 2 via the inter-crankcase vent 22 is now able to pass through the opened fuel injection port 13 formed in the piston crown. As noted in FIG. 1, the piston rod 6 has a terminal end which acts to control communication between the combustion chamber space between the pistons and the crankcase 2 as the piston reciprocates.

Figure 2:
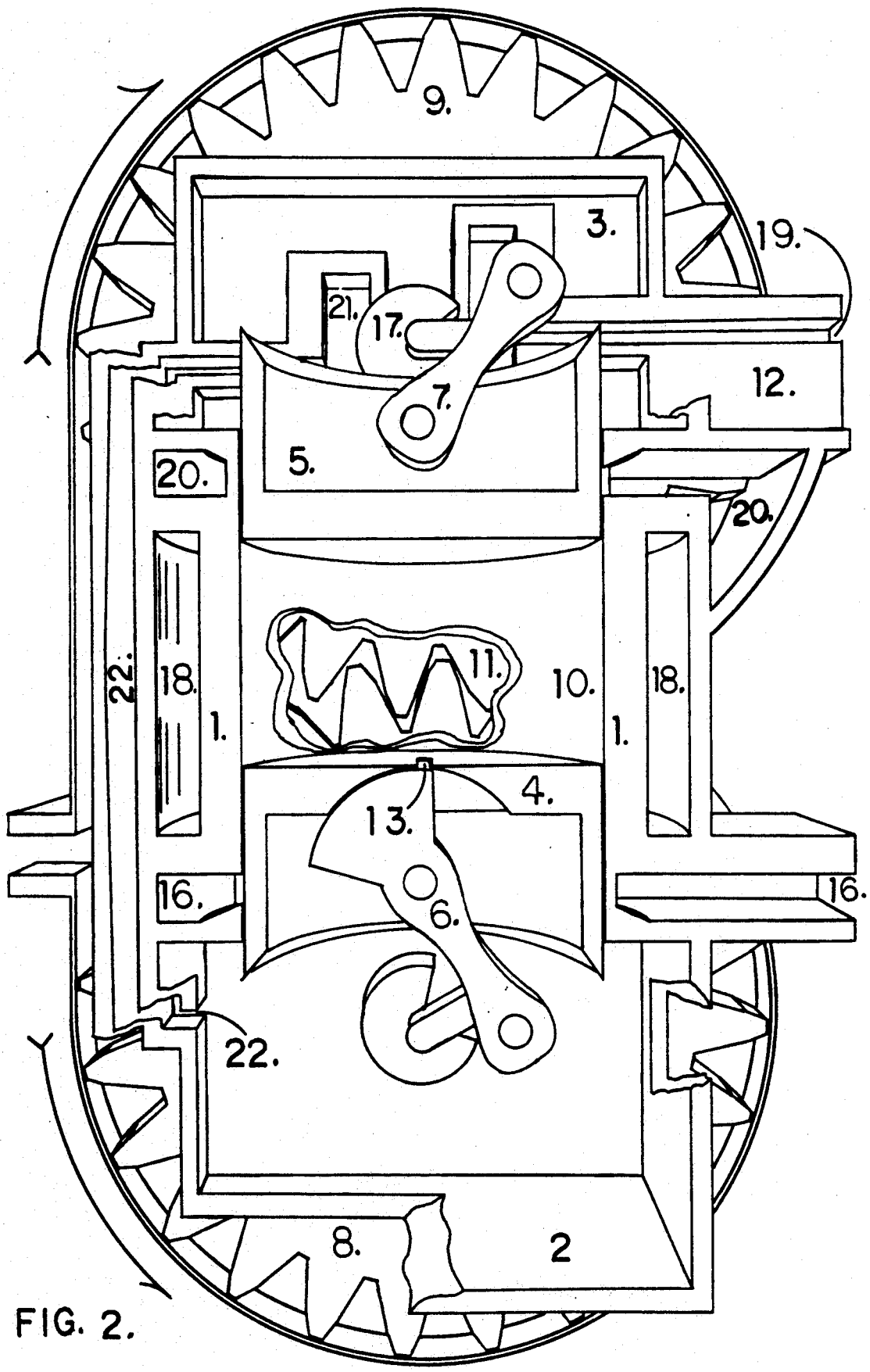
FIGS. 2-9 are perspective views of the instant invention as seen in FIG. 1 showing advancement of the pistons.

FIG. 2 illustrates the piston rod as now blocking the injection port 13 thereby prohibiting communication between the crankcase 2 and combustion space 10. The pistons are now continuing to advance in an upstroke toward each other causing compression of the entrapped charge.

Figure 3:
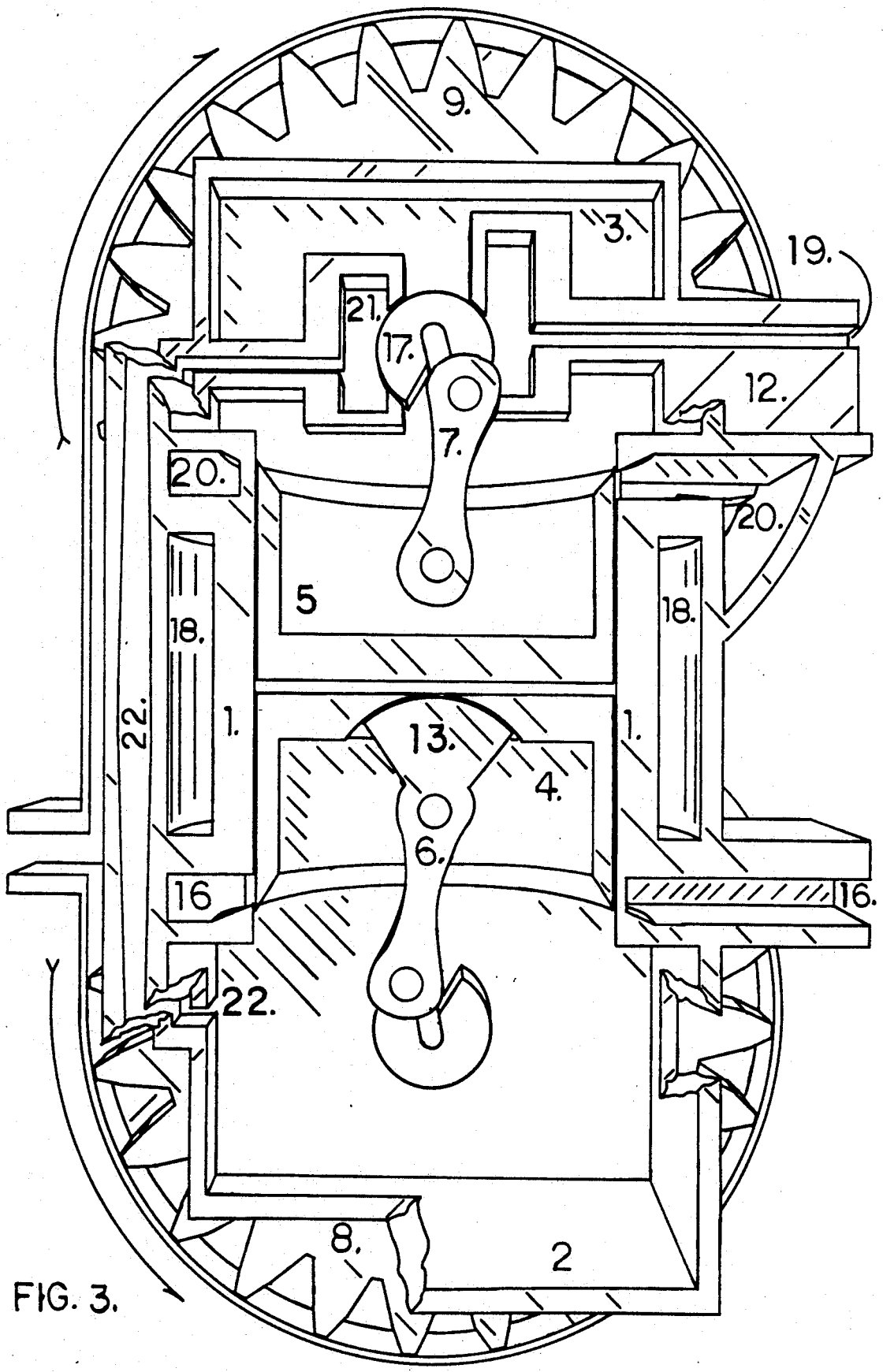

FIG. 3 shows the pistons at a position commonly associated with the top dead center position (TDC). The compression space between the two pistons 4 and 5 is very small and the counterweight rotary valve 17 is in a position to block communication between the crankcase 3 and each of the intake tube 19 and the inter-crankcase vent 22. At this phase of maximum piston advancement the engine obtains compression to such a degree that the temperature of the mixture rises to a point that the combustible mixture in the combustion space 10 ignites. The ignition of this highly compressed mixture produces heat which raises the pressure of the products of combustion. The pressure provides the force for driving the pistons 4 and 5 from each other as depicted in subsequent figures. Crankshaft torsion in minimal during the idling conditions. At full throttle torsion of the crankshafts will be maximum. It is recognized that a variable phase shift mechanism between the two pistons 4 and 5 should lower the compression ratio for less knocking under full load but raise compression to provide minimal stall speed when throttling down.

Figure 4:
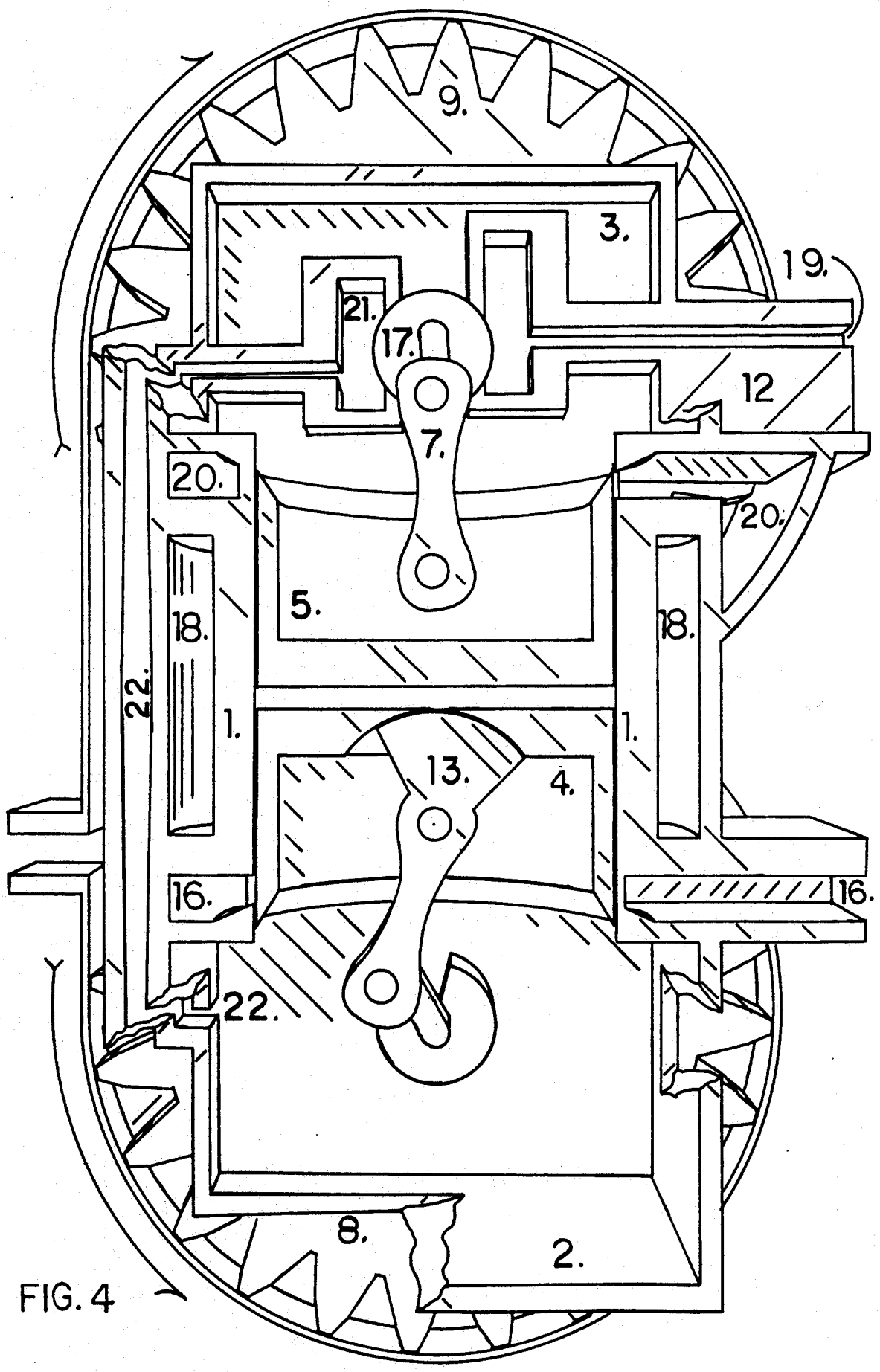

FIG. 4 depicts the piston rod 7 in an in-line relationship with the crankarm. The power imparted to the injection piston 4, by the exploding gases, forces the piston rod 6 to rotate and drive the crankshaft which in turn spin the flywheels of the crankshaft and flywheel assemblies 8 and 9. The peripheral gears of the flywheels act as a pump to force air into the manifold 20. Air enters via the intake air tube (not numbered) towards the gears and is peripherally directed to the manifold 20 as it is compressed due to the motion of the gears. The manifold 20 is in direct communication with the intake ports 14 which are controlled by the piston 5 as it reciprocates. Minutes amounts of blow-by gas leaking past the piston rings filter out through the exhaust ports 15 and out the exhaust pipe 16.

Figure 5:
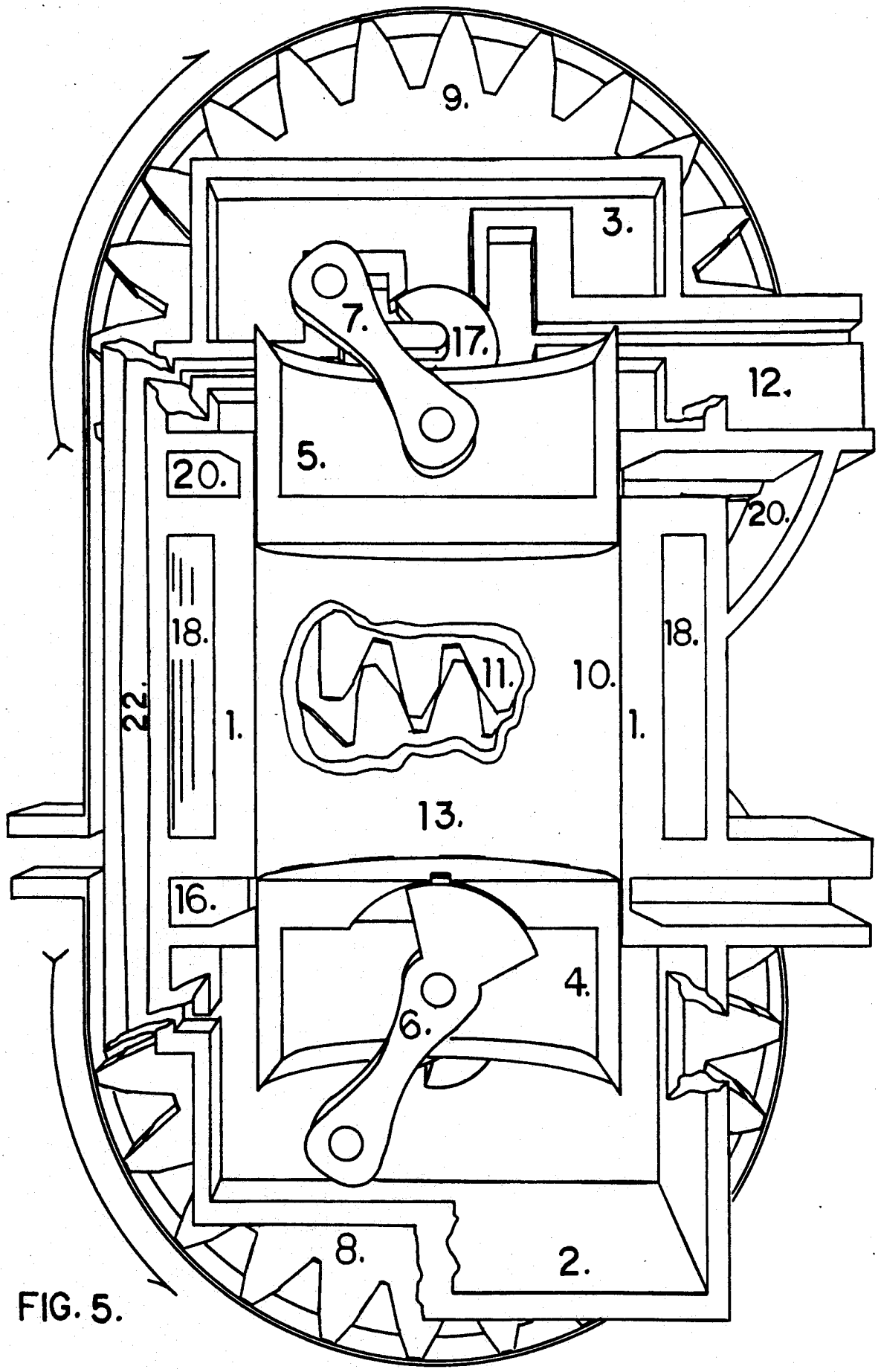

FIG. 5 illustrates the piston 4 advancing in a downstroke wherein the piston crown is about to uncover the exhaust ports 15. It is noted that the pre-compression piston crown 5 has not yet reached a position allowing communication between the combustion space 10 and the intake ports 14. Further note that the piston rod 6, which controls the fuel injection port 13, is essentially in a extreme extended position within the depression. In this extreme positon it continues to block passage of fuel from the crankcase 2 to the combustion space 10.

Figure 6:
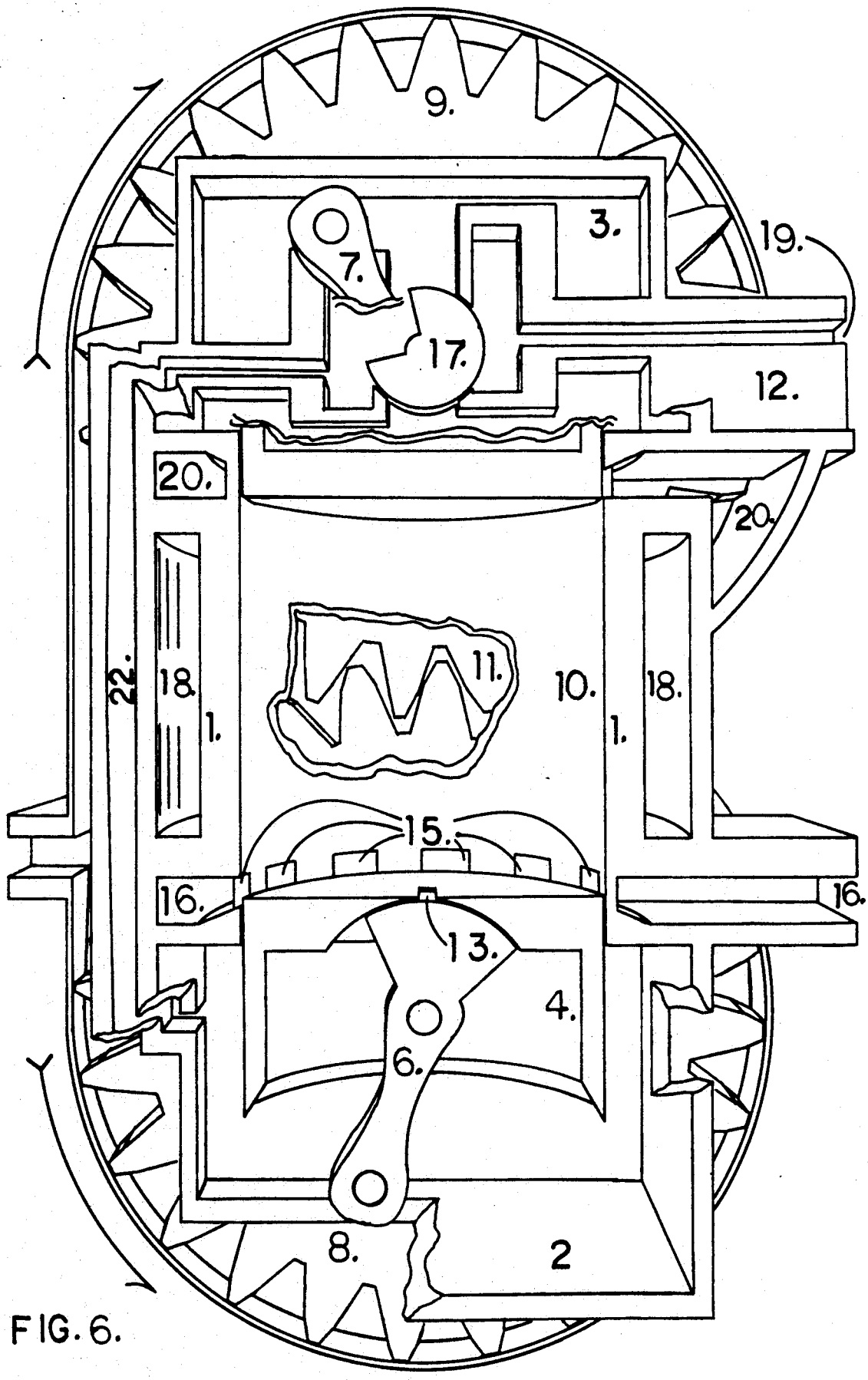

FIG. 6 shows the combustion space 10 in open communication with the exhaust ports 15 and simultaneously illustrates the piston 5 as reaching a position wherein it is about to uncover the intake ports 14 in the cylinder wall. The piston rod 6 is beginning to rotate in an opposite direction to that as seen in FIG. 4 as it begins to advance towards the opposite extreme position from that depicted in FIG. 5.

Figure 7:
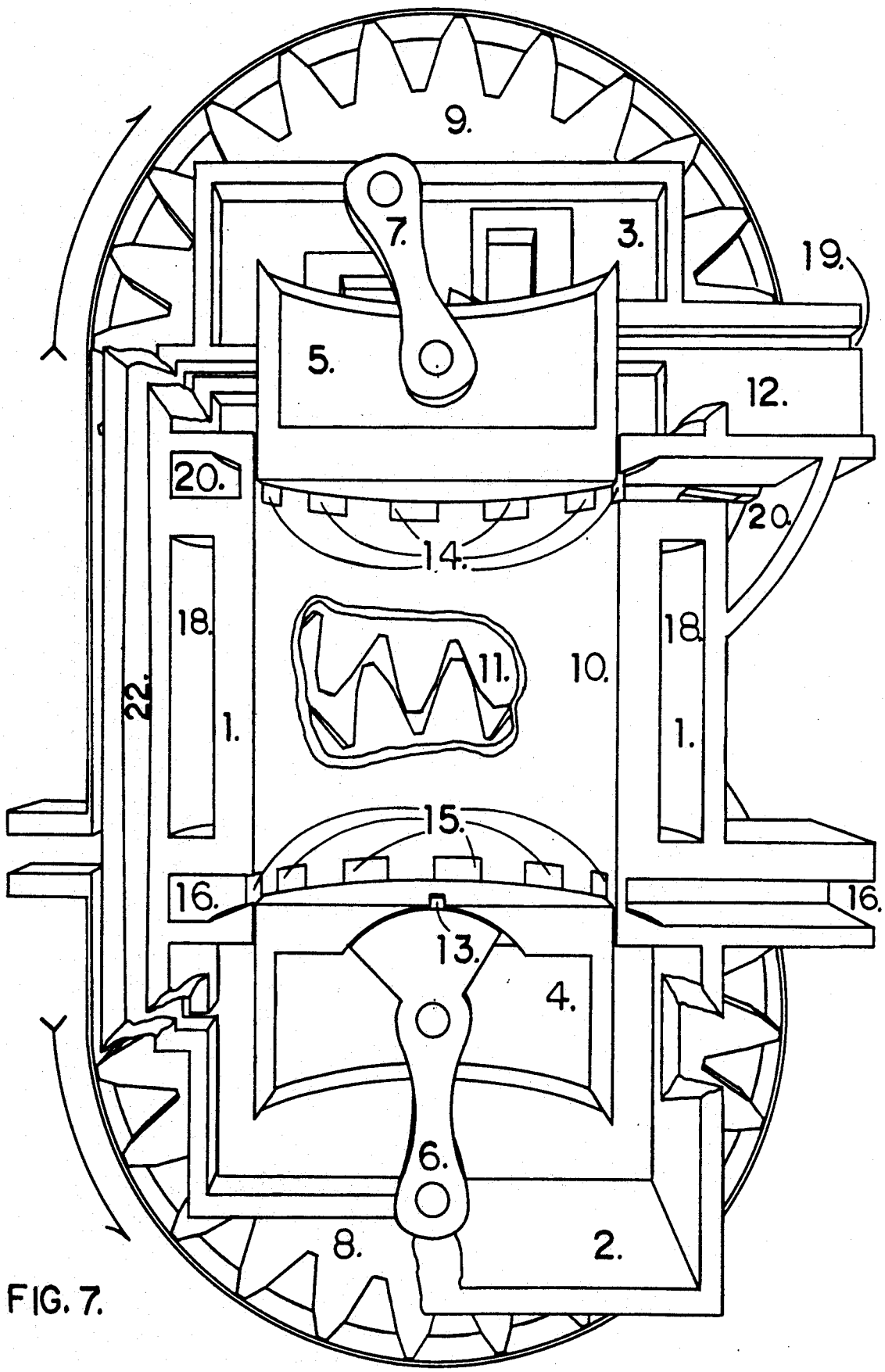

FIG. 7 illustrates the fully open exhaust ports 15 and intake ports 14 as the combustion space is being scavenged of the combustion gases and the pistons 4 and 5 are in the bottom dead center position (BDC). The counterweight rotary valve 17 has uncovered the inter-crankcase vent port 21 allowing passage of charge through inter-crankcase vent 22 to the injection crankcase 2.

Figure 8:
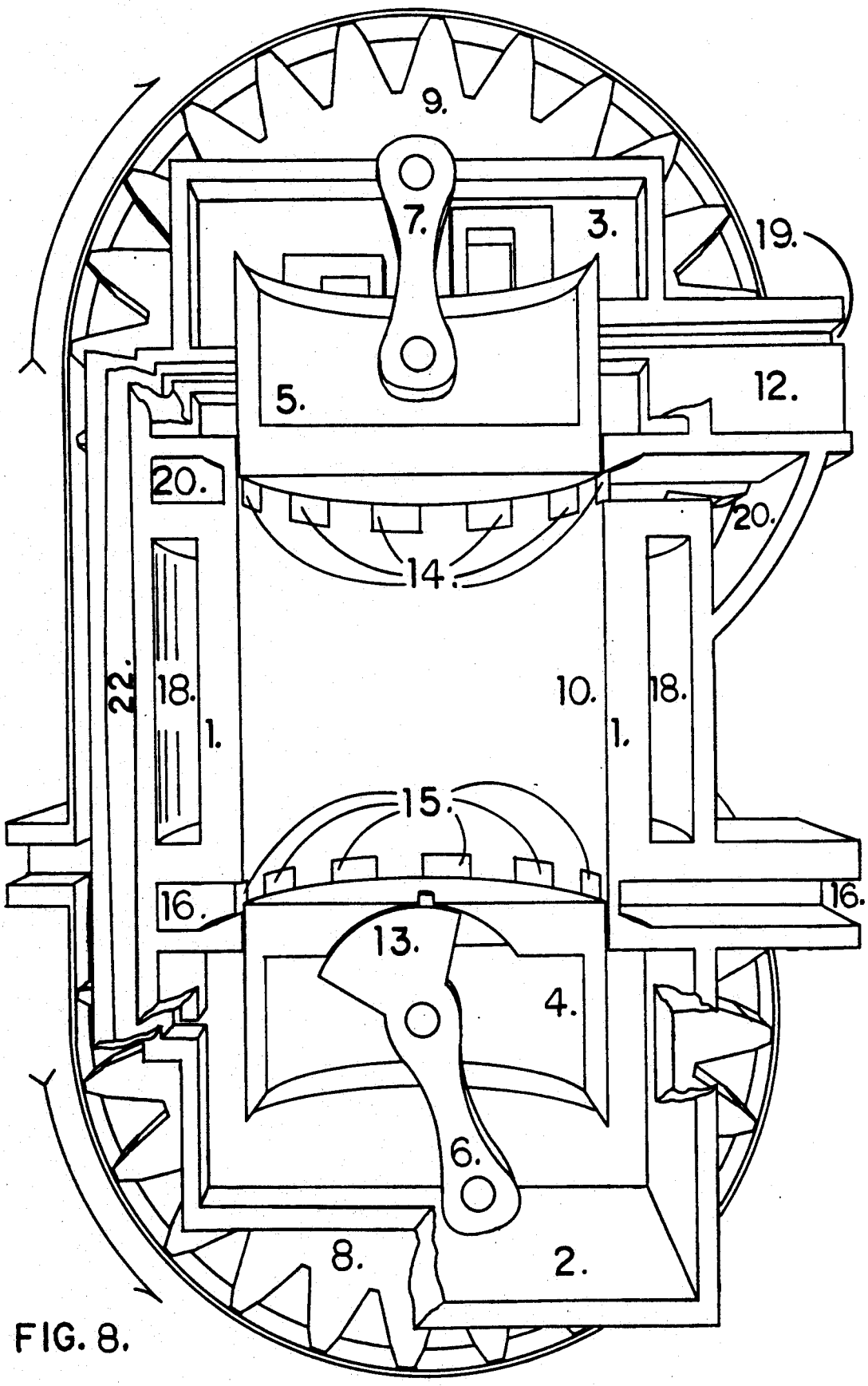

FIG. 8 shows the pistons 4 and 5 as remaining in BDC as the piston rod 7 aligns with the crankarm of the crankshaft assembly 9. This allows the pre-compressed air to continue to pass through the combustion space 10 and out through the exhaust ports 15 to complete the exhaust gas washout and to also cool the cylinder from its combustion heat. Note that a surrounding water jacket 18 is also provided to aid in this purpose.

Figure 9:
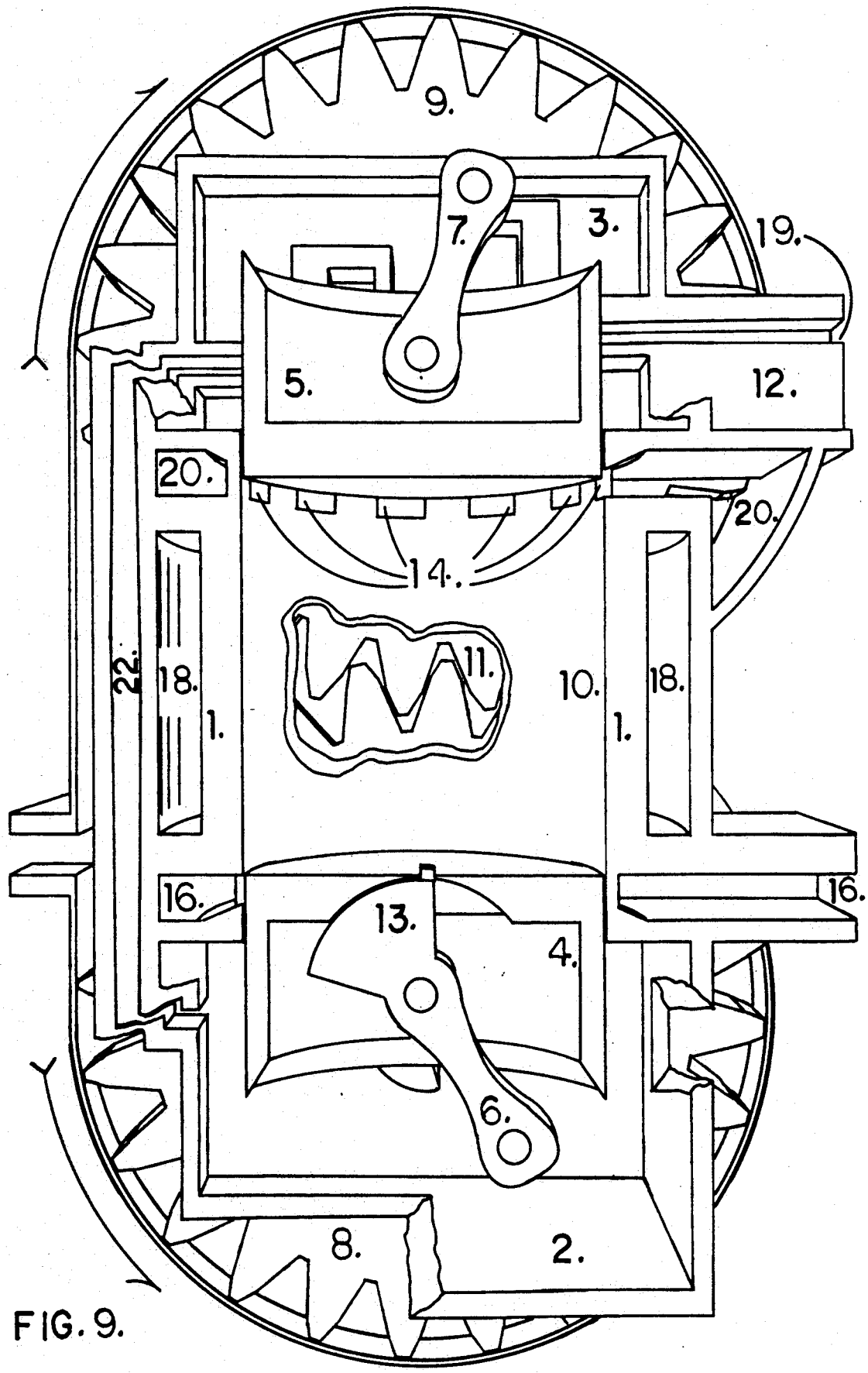

FIG. 9 illustrates final closure of the exhaust ports 15 as the pistons 4 and 5 advance in an upstroke. The intake ports 14 remain open for a period of time after the exhaust ports 15 have fully closed thereby introducing fresh pre-compressed air into the combustion space 10 for subsequent compression and ignition as depicted in the prior figures. Note that the piston rod 6 is about to open communication between the crankcase 2 and the combustion space 10 for introduction of the fuel mixture.

Although only a preferred embodiment of the two cycle opposed piston internal combustion engine has been specifically illustrated and described herein, it is to be understood that minor variations may be made in the internal combustion engine without departing from the spirit and the scope of the invention, as defined by the appended claims.

I claim:

1. An internal combustion engine having at least one of each of an intake port, exhaust port and fuel inlet port; a pair of opposed pistons within a cylinder of said engine defining a combustion chamber; one of said pair of pistons opening and closing said at least one exhaust port, said one piston including said fuel inlet port therethrough; a connecting rod operatively connecting said one piston to a driven shaft, said connecting rod having an end portion which opens and closes said fuel inlet port.

2. The engine according to claim 1 having a connecting rod for each said piston, each said connecting rod operatively connected to a respective driven shaft, each said driven shaft being in the form of a crankshaft, each said crankshaft having a respective gear; said pair of gears engaged together to form a pump.

3. The engine according to claim 2 wherein said pump provides compressed air to said at least one intake port.

* * * * *